United States Patent [19]

Baker

[11] 4,372,371

[45] Feb. 8, 1983

[54] TRUNNION AIR SEAL

[75] Inventor: Roderick J. Baker, Belmont, N.Y.

[73] Assignee: The Air Preheater Company, Inc., Wellsville, N.Y.

[21] Appl. No.: 310,567

[22] Filed: Oct. 13, 1981

[51] Int. Cl.[3] ..... F28D 19/00

[52] U.S. Cl. ..... 165/9; 165/8

[58] Field of Search ..... 165/8, 9

[56] References Cited

U.S. PATENT DOCUMENTS 2,666,624 1/1954 Flurschutz ..... 165/9

*Primary Examiner*—Albert W. Davis, Jr.

*Attorney, Agent, or Firm*—William W. Habelt

[57] ABSTRACT

A trunnion sealing means for a rotary regenerative heat exchange apparatus. The sealing means is separated into two independent portions. The first portion is an air seal 34 that lies concentrically around a continuously moving trunnion 32. A supply of pressurized air is supplied thereto to preclude the leakage of fluid from the rotor of the rotary regenerative heat exchange apparatus. A second portion of said seal comprises a spool 56 radially spaced from the trunnion and having walls that are permitted to move relatively only an insignificant amount not sufficient to abrade or otherwise harm a packing material 36 therein.

6 Claims, 2 Drawing Figures

TRUNNION AIR SEAL

BACKGROUND OF THE INVENTION

Rotary regenerative heat exchange apparatus comprises essentially a rotor post supporting sector shaped baskets that extend radially outward therefrom and contain a mass of heat absorbent material. The rotor post and the sectorial baskets are rotated whereby they may be alternately exposed to hot and cold fluids in order that heat absorbed from the hot fluid may be transferred to the cold fluid flowing therethrough.

The rotor is surrounded by a housing formed with end plates at spaced ends that contain openings to simultaneously direct a heating fluid and a fluid to be heated through the heat absorbent material of the rotor.

Inasmuch as the hot and cold fluids flowing through the rotor are maintained at various levels of pressure, either above or below that of the surrounding atmosphere, there is a strong tendency toward leakage between fluids in the high and low pressure zones and the surrounding atmosphere.

To guard against excess leakage of fluid, extensive measures must accordingly be taken to provide sealing arrangements that effectively isolate the several fluids from one another and from the atmosphere.

DESCRIPTION OF THE PRIOR ART

Post sealing means as known in the prior art have various designs and dimensions, and they utilize different features to effectively isolate the several fluids. Contact seals of the type illustrated by U.S. Pat. No. 3,822,739 provide packing rings that occupy a space between fixed housing structure and a rotating shaft, while a device of the type shown by U.S. Pat. No. 3,980,128 discloses the use of a high pressure air chamber between bands of packing material. U.S. Pat. No. 4,159,033 shows a further development where spaced air chambers are used exclusively to preclude leakage from an air preheater. In the former cited patents a packing material of heat resistant ceramic wool was used. However, this material when subjected to constant abrasion soon broke down into a fine powder-like dust that was exhausted into the atmosphere. In U.S. Pat. No. 4,159,033 the entire sealing effect is produced by a pressurized air chamber, while cooling of the space adjacent the end plate is effected by a continuous supply of cooling air to a concentric chamber. An interruption in the flow of cooling air would permit overheating of the air seal, the trunnion, the support bearing, and other adjacent housing structure.

SUMMARY OF THE INVENTION

This invention is therefore directed to a trunnion sealing means that provides the advantages of both an air seal and those of a packing type seal. Moreover, the parts of the seal are separated so that the air type seal is adapted to seal between continuously moving parts while the packing seal is adapted to seal between parts of the heat exchanger that have no significant amount of relative movement therebetween. Thus, the packing material therein will withstand long periods of operation without any excessive amount of fiber breakdown and deterioration, and will therefore remain effective for long periods of time.

As above stated, the seal is separated into two distinct parts, the first part being a packing type seal that precludes the flow of gases and heat past the sector plate, while the second part thereof is an air seal that precludes the flow of air and other gases axially along the rotor post.

The first part of the seal has relatively fixed chamber walls that are adapted to contain the packing material therein while precluding movement and abrasion of the packing material to thus substantially lengthen the effective life of the seal. This part of the seal resists the flow of heat and air from within the passages of the rotor.

The second part of the seal has chamber walls that rotate freely with respect to one another. However, only pressurized air is contained in the sealing chamber formed by the movable walls whereby an effective sealing effect substantially free from breakdown or deterioration is produced between relatively movable surfaces.

Both parts of the seal are carried by spaced tracking rods that are adjustably secured to a yoke that is in turn carried by a guide bearing axially movable in response to thermal expansion of the rotor post and its axially extending trunnion. The tracking rods are readily accessible for adjustment or repair, they are short, and they traverse a portion of the apparatus that is not subjected to extremes of heat.

DESCRIPTION OF THE PREFERRED EMBODIMENT

Figure 1:
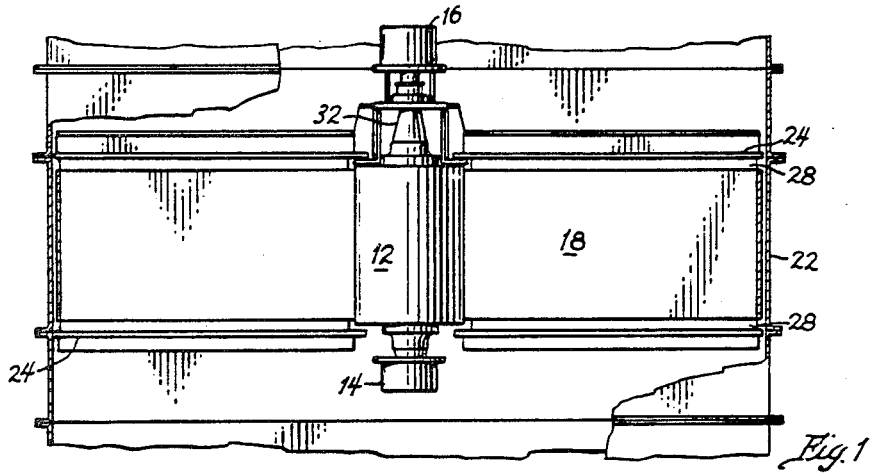
FIG. 1 is a sectional elevation of a rotary regenerative heat exchanger having a shaft sealing means constructed in accordance with the invention.
Figure 2:
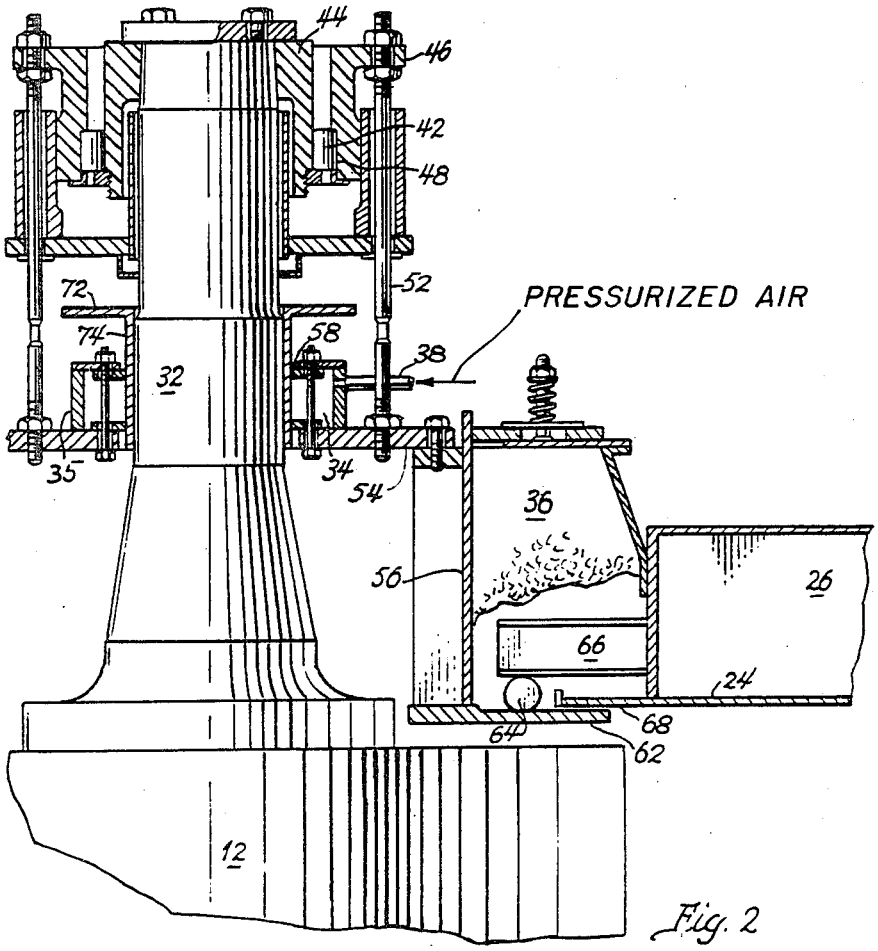
FIG. 2 is an enlarged detail, in section, that shows the sealing means of the invention intermediate the trunnion and the surrounding housing structure.

The arrangement illustrated in the drawing relates to a rotary regenerative heat exchanger having a central rotor post 12 mounted on a support bearing 14 and adapted to rotate about a vertical axis within an upper guide bearing 16. A mass of heat absorbent material is contained in rotor 18 for rotation about the central rotor post. The rotor is contained in a housing 22 having end or sector plates 24 at opposite ends thereof with openings 26 therethrough that direct a heating fluid and a fluid to be heated through opposite sides of the rotor.

To preclude leakage of the several fluids from flowing into or out of their prescribed passageways, sealing means that include circumferential seals 28 around the periphery of the rotor and rotor post seals between trunnion 32 and the housing are provided.

In the form of the invention illustrated in the drawing, the rotor post seal is divided into two parts, an air seal 34 that precludes fluid flow axially along the rotor post, and a packing type seal containing mineral wool or the like that precludes fluid flow and thermal flow around the end of a sector plate.

The packing type seal is especially adapted to preclude the flow of heat and fluid from the rotor, while the air seal is adapted to particularly preclude the flow of fluid along the trunnion to the guide bearing.

The packing type seal is filled with a heat resistant, fibrous mineral wool that increases the resistance to fluid flow therethrough. The walls of said seal are designed to permit minimum movement whereby the fibrous packing therein is not subjected to constant abrasion and movement. Consequently there is little breakdown of the fibrous insulation and the elongate fibers remain intact for long periods of continuous use. By way of contrast, the walls of the air seal 34 formed by cylindrical collar 35 around the relatively movable trunnion 32 rotate relative to one another continuously. However, the sealing chamber 34 contains only pressurized air as supplied through inlet 38, so there is no tendency for breakdown of the packing material therein.

In the device of the invention, a guide bearing 42 is provided adjacent the upper trunnion 32. The guide bearing is carried at the upper end of the upper trunnion in order that axial expansion of the rotor post will be reflected in similar movement of the support yoke 44 therefor, but will preclude lateral movement of the trunnion. The guide bearing is surrounded by a housing having an outer rail 48 for the bearing and including ears 46 from which hanger rods 52 depend vertically therefrom.

The hanger rods 52 support an annular plate 54 that carries the collar 35 on the upper side thereof concentrically about the trunnion. A conventional annular contact seal 58 is adapted to rub against wear sleeve 74 to preclude pressurized air supplied from source 38 from excessive leakage from air seal 34 along with the air or other fluid contained within the heat exchanger.

Depending from the outer periphery of annular plate 54 and in alignment with the inner end of radially disposed sector plate 24 is a cylindrical sleeve 56 that carries a second annular flange 62 at the lower end thereof for the support of a friction-free roller 64 on which an extension 66 to sector plate 24 rests, whereby it is free to expand radially in response to thermal variation. An intermediate extension 68 at the end of the sector plate 24 provides a labyrinth type seal that additionally retards fluid flow up through packing 36.

A flange 72 lying normal to the upper end of wear resistant sleeve 74 around trunnion 32 is adapted to laterally deflect any leakage gases that escape through seal 34 and thus preclude them from reaching guide bearing 42. Inasmuch as most leakage gases are at an elevated pressure and temperature, they could deleteriously affect the bearing and the support means therefor.

I claim:

1. Regenerative heat exchange apparatus including a rotor having a vertical rotor post, an upper trunnion integral with the rotor post extending upward therefrom, a lower trunnion extending down from the lower end of the rotor post, a rotor shell positioned concentrically around the rotor post adapted to provide an annular space for a mass of heat absorbent material, housing means surrounding the rotor including inlet and outlet openings for a heating fluid and for a fluid to be heated together with axially movable sector plates that direct the heating fluid and the fluid to be heated through the heat absorbent material of the rotor, a support bearing adapted to support the lower trunnion for rotation about its vertical axis, a guide bearing around the upper trunnion adapted to preclude lateral movement thereof, a first sealing means between the upper trunnion and the rotor housing adapted to preclude the flow of fluid therebetween, said sealing means comprising an annular plate that concentrically surrounds the upper trunnion, an annular housing carried by said annular plate, said annular housing having an open side that confronts the trunnion to comprise an air seal that precludes fluid flow thereby, a source of pressurized sealing fluid, means for supplying the pressurized fluid to said air seal, spool means depending from said annular plate surrounding the trunnion and having a laterally extending rim that supports the radially inner end of an adjacent sector plate, and packing means carried by the rim of said spool means intermediate the sector plate and the spool means adapted to provide an independent sealing means that precludes the flow of heat and fluid from the rotor.

2. Regenerative heat exchange apparatus as defined in claim 1 wherein the first and second sealing means lie at the end of the rotor adjacent the inlet for heating fluid.

3. Regenerative heat exchange apparatus as defined in claim 2 adapted to include an annular sleeve concentrically abutting said trunnion, and an annular deflector extending radially outward therefrom adapted to direct hot leakage gases away from the guide bearing.

4. Regenerative heat exchange apparatus as defined in claim 3 wherein the annular sleeve comprises an annular inner wall of said air seal.

5. Regenerative heat exchange apparatus as defined in claim 4 including hanger means that depends vertically from the guide bearing to the annular plate whereby axial movement of the guide bearing will induce a sympathetic movement of the annular plate and of the spool means supported thereby.

6. Regenerative heat exchange apparatus as defined in claim 5 including a friction-free bearing intermediate the laterally extending rim of said spool means and the end of the sector plate supported thereby whereby the sector plate is free to move radially in response to a change of temperature.

* * * * *